United States Patent [19]

Shaffer

[11] Patent Number: 4,780,958

[45] Date of Patent: Nov. 1, 1988

[54] METHOD OF MAKING AN ELECTRICAL TERMINAL FOR A PRINTED CIRCUIT BOARD

[75] Inventor: Howard R. Shaffer, Millersburg, Pa.

[73] Assignee: AMP Incorporated, Harrisburg, Pa.

[21] Appl. No.: 152,290

[22] Filed: Feb. 4, 1988

Related U.S. Application Data

[62] Division of Ser. No. 915,931, Oct. 6, 1986, Pat. No. 4,735,575.

[51] Int. Cl.[4] ..... H01R 43/16

[52] U.S. Cl. ..... 29/874; 29/747; 29/882

[58] Field of Search ..... 29/747, 874, 882; 439/82, 84, 751, 825, 826, 827, 869, 873

[56] References Cited

U.S. PATENT DOCUMENTS

| | | | |
|---|---|---|---|
| 2,925,577 | 2/1960 | Cetran et al. . | |
| 3,440,597 | 4/1969 | Baker II et al. . | |
| 4,428,642 | 1/1984 | Schwindt et al. . | |
| 4,464,009 | 8/1984 | Thaler . | |
| 4,475,780 | 10/1984 | Walter et al. . | |
| 4,735,575 | 4/1988 | Shaffer | 439/82 |

FOREIGN PATENT DOCUMENTS 2049739 4/1972 Fed. Rep. of Germany .

*Primary Examiner*—Howard N. Goldberg
*Assistant Examiner*—Taylor J. Ross
*Attorney, Agent, or Firm*—Anton P. Ness

[57] ABSTRACT

A contact terminal for insertion into a plated through-hole of a printed circuit board is formed from thin metal stock of uniform thickness with a tubular compliant mounting section. A plurality of slits are spaced around the mounting section, and along one side of each slit are a pair of outward projections to engage the wall of the plated through-hole so that the metal on one side of each slit is deflected radially inwardly by the plated through-hole when the terminal is inserted, to mechanically secure the terminal therein. Outer edges of the projections along the slits penetrate the plating material during insertion. A method for making such a terminal includes piercing the mounting portion area of the blank, forming slits therein, forming projections along one side of each slit to extend out of the plane of the blank, and rolling at least that portion of the terminal into a tubular shape so that the pairs of projections extend radially outwardly.

2 Claims, 3 Drawing Sheets

METHOD OF MAKING AN ELECTRICAL TERMINAL FOR A PRINTED CIRCUIT BOARD

This is a divisional application of application Ser. No. 915,831 filed Oct. 6, 1986, now U.S. Pat. No. 4,735,575.

FIELD OF THE INVENTION

The present invention relates to electrical contact terminals and more particularly to terminals for connection to printed circuit boards.

BACKGROUND OF THE INVENTION

Electrical contact terminal posts are known which can be electrically connected to printed circuit boards by insertion through plated through-holes of a board and secured therein without solder. Such terminal posts have compliant mounting sections therealong which bear against and are spring biased inwardly by the plated walls of the through-holes, where the spring force is high enough that assured mechanical gripping is maintained, as well as assured electrical connection being established.

Terminal posts such as those of U.S. Pat. No. 4,186,982 are formed from solid bar stock having a square cross-section of standard size, usually 0.025" square or 0.045" square. Those of U.S. Pat. Nos. 4,017,143; 4,076,356; 4,166,667; 4,191,440; and 4,381,134 have solid post contact sections and adjacent C-shaped compliant mounting sections formed of thinner metal stock than that of the post contact sections, requiring a milling operation prior to stamping the blank. The C-shaped section offers spring characteristics which are enhanced by reducing the thickness of the arms of the C-shape.

Protuberances are sometimes used along the C-shaped compliant mounting sections to break through surface oxides on the plating material for good electrical connection, as disclosed in U.S. Pat. No. 3,783,433. Axially extending ridges or ribs are used in U.S. Pat. No. 4,076,356 to actually penetrate into the plating material as also taught in U.S. Pats. Nos. 3,416,122 and 4,186,982.

It is desirable to form a terminal from relatively thin sheet metal stock of uniform thickness to reduce the metal content of the terminal and facilitate creating desired contact section structures on an end thereof, and eliminate the necessity of milling operations.

It is further desirable to form such a terminal to have proturberances to establish an assured electrical connection with the internal surface of a plated through-hole.

SUMMARY OF THE INVENTION

A terminal post of the present invention is formed from a blank stamped from thin sheet metal stock having a uniform thickness such as 0.008 inches. In the intermediate portion of the blank to become the compliant mounting section, a plurality of axial slits are punched therein by a die piercing the blank. The metal on one side of each slit is pushed out of the plane of the blank to a selected limited extend preferably at two axially spaced locations to create a pair of projections extending to edges at the slit, while the metal on the other side of each slit is undeformed. Each pair of projections and the adjacent metal on the one side of the slit define a spring vane, and preferably the several slits of the blank and their adjacent areas are identical from slit to slit. Then when at least the intermediate portion of the terminal is formed into a tubular shape, the resultant compliant mounting section contains a plurality of parallel spring vanes spaced around the circumference with the projections extending outwardly and generally tangentially in a common direction either clockwise or counterclockwise to sharp outer edges along the slits. The outer edges of the projections define an effective diameter larger than the general diameter of the compliant mounting section. Upon press-fit insertion of the compliant mounting section into a plated board through-hole having a diameter smaller than the effective diameter, the vanes act as springs to be deflected slightly radially inwardly and maintain a spring force outwardly against the internal surface of the hole to mechanically secure the terminal therein. The outer edges penetrate the plating material during insertion which both establishes an assured electrical connection by breaking through the oxide layer and minimizes overdeflection of the spring vanes.

According to one aspect of the invention, a terminal for mounting in a board through-hole is formed from a thin metal blank of uniform thickness and has at least a tubular compliant mounting section having walls of uniform thickness.

According to another aspect of the invention the compliant mounting section of such a terminal has a plurality of circumferentially spaced axially disposed vanes which simultaneously act as spring means for mechanical gripping and as penetration means for assured electrical connection. Portions of the metal blank on one side of each slit may be pushed outward from the plane of the blank while the metal on the other side is undeformed, which creates more pronounced outwardly extending projections on one side of each slit when the blank is formed into a tubular shape at least at the compliant mounting portion which projections are deflectable inwardly during insertion to comprise spring members.

According to still another aspect of the invention, the terminal may have one or both ends formed into a pin contact section, a socket contact section, or a wire-wrap post as taught in U.S. Pat. No. 3,420,087.

DETAILED DESCRIPTION OF THE PREFERRED EMBODIMENT

Figure 1:
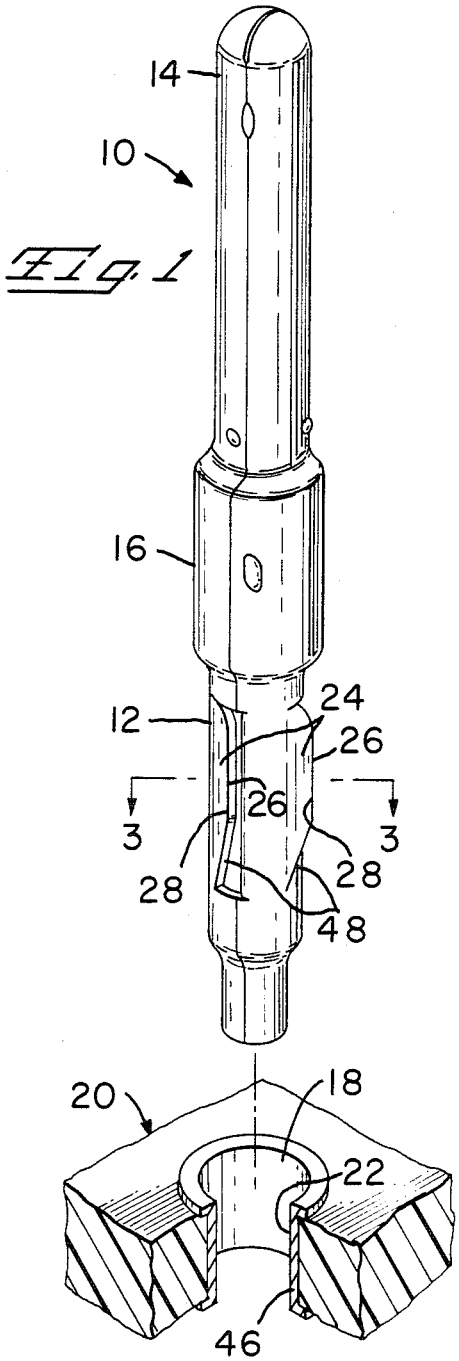
FIG. 1 is a perspective view of a terminal of the invention prior to insertion into a board through-hole.

A contact terminal 10 is shown in FIG. 1 which has a compliant mounting section 12, a pin contact section 14, and a retention section 16 which would provide for retention in a dielectric housing (not shown). Pin contact section 14 is conventional and would mate with a conventional socket contact (not shown). Compliant mounting section 12 is insertable into a plated through-hole 18 of a printed circuit board 20 to secure terminal 10 to board 20 by mechanically gripping internal surface 22 of through-hole 18 and simultaneously establishing electrical connection therewith. A plurality of vanes 24 are spaced around the circumference of compliant mounting section 12 between tubular end portions of mounting section 12 which end portions remain integrally joined by axially extending portions. Vanes 24 extend tangentially outwardly therefrom preferably in a common direction either clockwise or counterclockwise, each to free end 26 having a relatively sharp outer edge 28. Sharp edges 28 collectively define an effective diameter larger than the general diameter of compliant mounting section 12 and larger than the inside diameter of plated through-hole 18. A plurality of terminals 10 can be secured in a housing to result in a connector such as a Metrimate connector manufactured by AMP Incorporated, Harrisburg, PA which is mountable to a printed circuit board.

Figure 2:
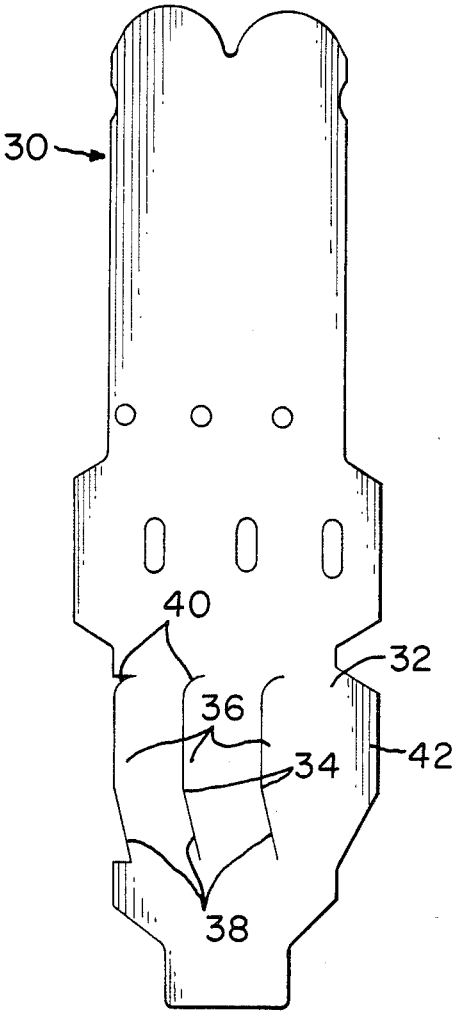
FIG. 2 is a plan view of a stamped terminal blank prior to forming.

FIG. 2 illustrates a blank 30 stamped from a strip of relatively thin sheet metal such as brass which has a uniform thickness of for example 0.0125 inches. Portion 32 of blank 30, which will become the compliant mounting section of the finished terminal, is pierced by a die at slits 34; and the metal portions 36 between slit end points near ends of mounting section 12 and along a common side of slits 34 will define the vanes of the invention. Preferably the leading ends 38 of slits 34 are angled slightly from axial to facilitate insertion of the finished terminal into a through-hole. Trailing ends 40 of slits 34 are curved sharply to extend substantially normally a small distance from the axial portion of slits 34 to enable metal portions 36 to become short tab-like spring vanes 24 when the compliant mounting section 12 is created by tubular shaping of blank portion 32. A lateral tab 42 may be formed on blank 30 parallel to slits 34 which will be bent normally outwardly of the plane of the blank in the direction which will comprise the inside of the tubular compliant mounting portion.

Figure 3:
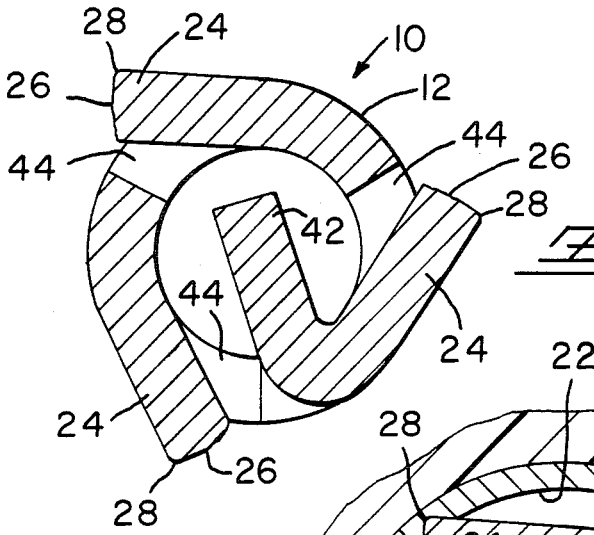
FIG. 3 is a cross-sectional view of the compliant mounting section taken along lines 3—3 of FIG. 1.

FIG. 3 is a cross-section of compliant mounting section 12 of terminal 10 formed from blank 30. Free ends 26 of vanes 24 extend tangentially outwardly when blank 30 is formed into a tubular shape by conventional forming, creating vacancies 44 radially inwardly from free ends 26 of vanes 24. Lateral tab 42 extends into the center of the tubular compliant mounting section 12 which increases the current-carrying capability of compliant mounting section 12 and also provides increased strength therein; this is especially important in smaller diameter terminals.

Figure 4:
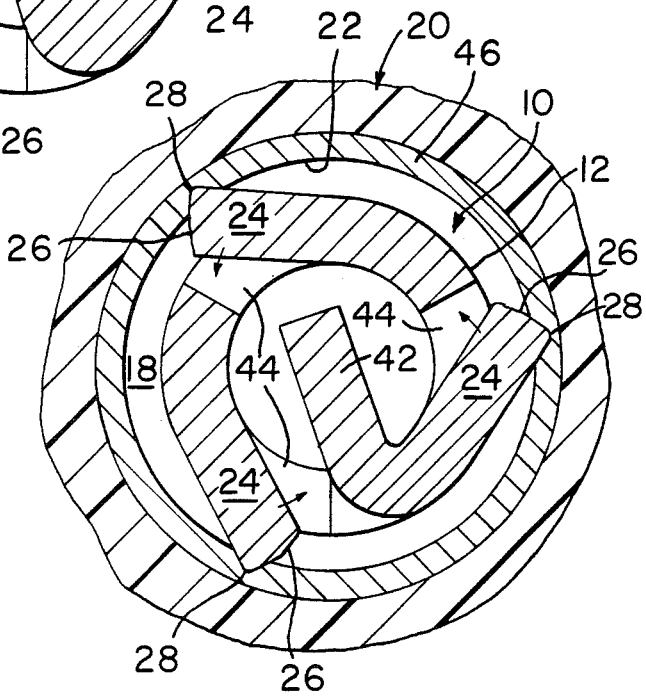
FIG. 4 is a cross-sectional view similar to FIG. 3 after insertion into a plated through-hole.

As shown in FIG. 4, force-fit insertion of compliant mounting section 12 into plated through-hole 18 results in slight deflection of vanes 24 radially inwardly into vacancies 44 by the internal surface 22 of the hole. Vanes 24 act as springs by comprising short wide tab-like cantilever arms which apply radially outward spring force against internal surface 22. Edges 28 are sharp enough (even if optionally deburred or coined) to penetrate into the plating material 46 during axial insertion of terminal 10 into hole 18, which break through the oxide layer which commonly forms on the plating material; this results in an assured electrical connection with the conductive plating material underneath the oxide layer. Such penetration also is believed to serve to minimize overdeflection of vanes 24 which could cause overstress, and also to serve to resist withdrawal of terminal 10 if axially rearward force is applied thereon. Referring to FIG. 1, it can be seen that leading ends 48 of vanes 24 resulting from leading slit end 38 inFIG. 2 extend at first only minimally outwardly from the generally tubular outer surface of compliant mounting section 12 and then increasingly outwardly proceeding axially therealong. During axial insertion leading ends 48 begin to engage internal surface 22 gradually which initiates the deflection of vanes 24.

Figure 5:
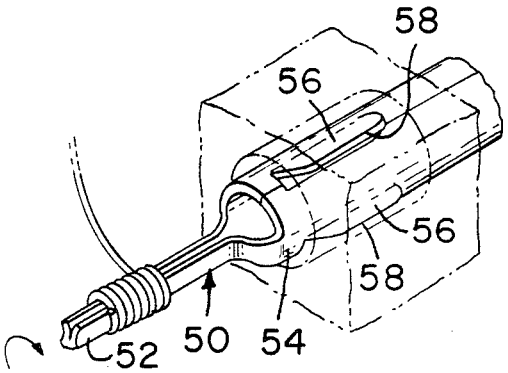
FIG. 5 is an alternate embodiment of the present invention with a wire-wrap terminal post contact section.

Reference to FIG. 4 also demonstrates that forwardly facing surfaces of free ends 26 of vanes 24 would resist rotation of terminal 10 in hole 18 in the particular direction vanes 24 extend because outer edges 28 would dig into plating material 46. This is beneficial for terminals which would be subjected to torque during or after insertion. FIG. 5 illustrates a terminal 50 having a wire-wrap post section 52 outwardly from compliant mounting section 54. Such a post section 52 can be formed by severely coldworking a U-shaped channel formed in the blank from which terminal 50 is made, as taught in U.S. Pat. No. 3,420,087 and in U.S. patent application Ser. No. 701,819 filed Feb. 19, 1985. If the conventional wrapping of wire is performed in the same direction as vanes 56 are disposed, the resultant induced torque will not succeed in causing rotation of the terminal in the plated through-hole because free ends 58 of vanes 56 will tend to bite into the plating material.

Figure 6:
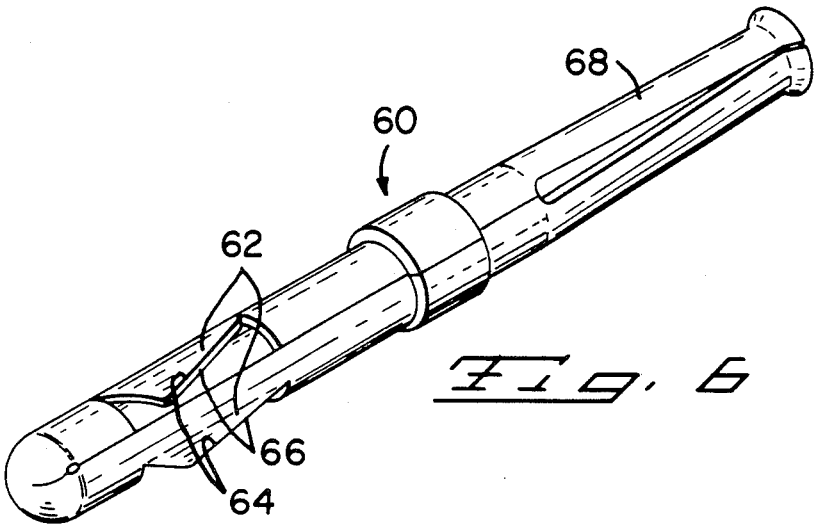
FIG. 6 is an alternate embodiment of the present invention with a socket contact section.

FIG. 6 illustrates an alternate embodiment of the spring vanes of the present invention. Terminal 60 has vanes 62 which are substantially disposed at an angle to the axial direction therealong, with the trailing ends 64 thereof normal to axial. While insertion into a plated through-hole would be facilitated as described in reference to leading ends 48 of FIG. 1, withdrawal would tend to be resisted by edges 66 tending to dig into the plating material when axially rearward force is applied on the terminal. Also illustrated in FIG. 6 is a socket contact section 68 whose features are conventionally known with stamped and formed contact terminals.

Figure 7:
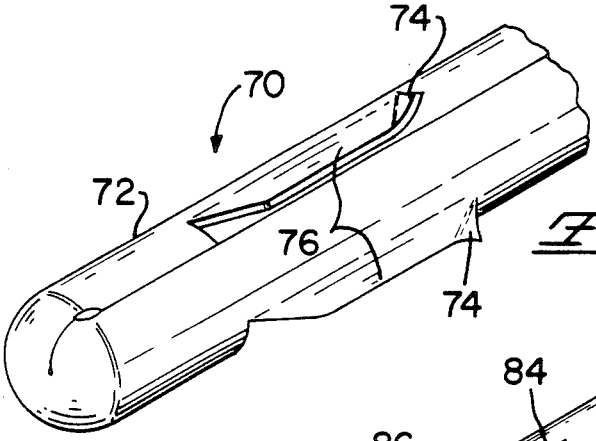
FIGS. 7 and 8 are alternate embodiments of the compliant mounting portion of the present invention.

FIG. 7 shows a variation on the present invention to resist withdrawal after insertion. Terminal 70 has a compliant mounting portion 72 wherein the trailing ends 74 of vanes 76 are pushed slightly out of the plane of the blank after the slits are pierced into the blank. Upon tubular shaping, vanes 76 will extend tangentially outwardly from portion 72 similarly to vanes 24 of FIGS. 1 to 4 but trailing ends 74 will extend farther radially outwardly, and will tend to penetrate into the plating material to resist withdrawal.

Figure 8:
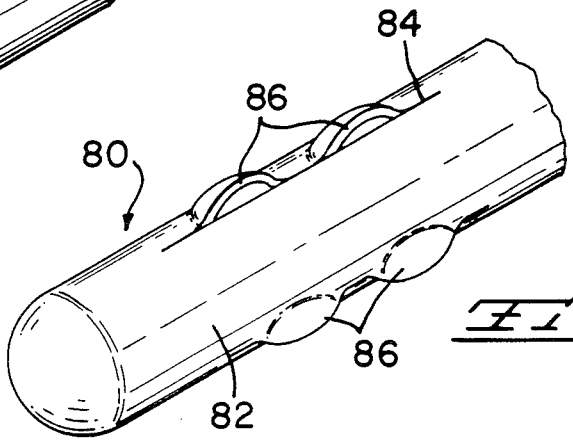

FIG. 8 exhibits an alternate embodiment of the present invention using straight slits pierced into a blank while still resulting in spring members deflectable radially inwardly upon insertion into a plated throughhole. Compliant mounting portion 82 of terminal 80 has axially extending slits 84 therealong. On a selected side of each slit 84, the metal portion of the blank has been deformed to push outwardly one or preferably two half-dimples 86 spaced inwardly from the ends of the slit, while the metal portion on the opposite side of the slit is undeformed. The outermost extent of half-dimples 86 defines the effective diameter of compliant mounting portion 82 greater than the inside diameter of the plated throughhole into which terminal 80 will be inserted. Upon insertion, half-dimples 86 will be together deflectable inwardly and act as spring members or vanes because of extended slits 84. Two such half-dimples 86 with each slit 84 tend to stabilize terminal 80 after mounting.

The present invention provides an effective compliant mounting section on a contact terminal for insertion into a plated through-hole of a printed circuit board, in a stamped and formed terminal made from thin sheet metal not requiring any milling or skiving operation to vary the thickness of the metal. A variety of contact sections can be formed integrally therewith at one or both ends of the terminal as desired including pin sections, socket sections, and wire-wrap posts; provided, of course, that at least one end be insertable through the plated through-hole. Three spring vanes are adequate although two or more than three may be used, and the particular contour or orientation thereof can be varied. Other modifications may be made to the present invention as desired, within the spirit of the invention and the scope of the claims.

What is claimed is:

1. A method of making a contact terminal suitable for insertion into a socket means of a printed circuit board and mechanically self-retaining therein in electrical engagement therewith, comprising the steps of:

selecting a sheet of metal of uniform thickness;

stamping a terminal blank therein having end portions;

piercing a selected portion of said blank intermediate said blank end portions at a plurality of locations to form substantially parallel and generally axial slits therealong between respective pairs of slit end points spaced from ends of said selected blank portion;

deforming a selected side of each said slit to form projections outward from the plane of the blank at said slit which taper into the plane of said blank at points spaced laterally from said slit and from an adjacent said slit, such that the metal portion on said selected side has an effective axial length greater than the metal portion on the other side of said slit, and such that axially extending portions of said selected blank portion between adjacent ones of said slits are undeformed;

forming at least said selected portion into a tubular shape such that said projections extend outwardly from said tubular shape and generally tangentially to free ends of said projections on said selected sides of said slits, said projection free ends comprising spring members and being deflectable radially inwardly by a socket means of a printed circuit board upon insertion thereinto; and forming at least one blank end portion into a contact section.

2. The method of claim 1 wherein said deforming step includes forming said projections at two spaced locations along each respective said slit to form axially spaced pairs of said projections.

* * * * *